United States Patent [19]

Hähn et al.

[11] Patent Number: 4,623,386

[45] Date of Patent: Nov. 18, 1986

[54] CARBOTHERMAL METHOD OF PRODUCING COBALT-BORON AND/OR NICKEL-BORON

[75] Inventors: Reinhard Hähn, Schwabach-Limbach; Hans-Joachim Retelsdorf, Zirndorf; Rüdolf Fichte; Siegfried Sattelberger, both of Nuremberg, all of Fed. Rep. of Germany

[73] Assignee: GfE Gesellschaft fur Elektrometallurgie mbH, Dusseldorf, Fed. Rep. of Germany

[21] Appl. No.: 808,895

[22] Filed: Dec. 13, 1985

[30] Foreign Application Priority Data

Jan. 17, 1985 [DE] Fed. Rep. of Germany ..... 3501403

[51] Int. Cl.[4] ..... C22B 4/00

[52] U.S. Cl. ..... 75/10.18; 420/129; 75/82

[58] Field of Search ..... 75/10, 11, 82, 129

[56] References Cited

U.S. PATENT DOCUMENTS 4,484,946 11/1984 Ototani ..... 75/82

4,536,215 8/1985 Coad ..... 75/129

*Primary Examiner*—Peter D. Rosenberg

*Attorney, Agent, or Firm*—Karl F. Ross; Herbert Dubno

[57] ABSTRACT

A method of making cobalt-boron and/or nickel-boron alloys in a low-shaft electrical furnace wherein the burden or charge has a height of at least 500 mm and at least a portion of its carbon carrier consists of wood chips which are carbonized to wood charcoal during the process so that the wood charcoal which is produced can adsorb volatilized boron compounds and tap them so that they do not escape. The volatilized boron compounds thus tapped are carried to the reduction zone by the wood charcoal so that a high yield is obtained and the product has a low aluminum content.

10 Claims, 1 Drawing Figure

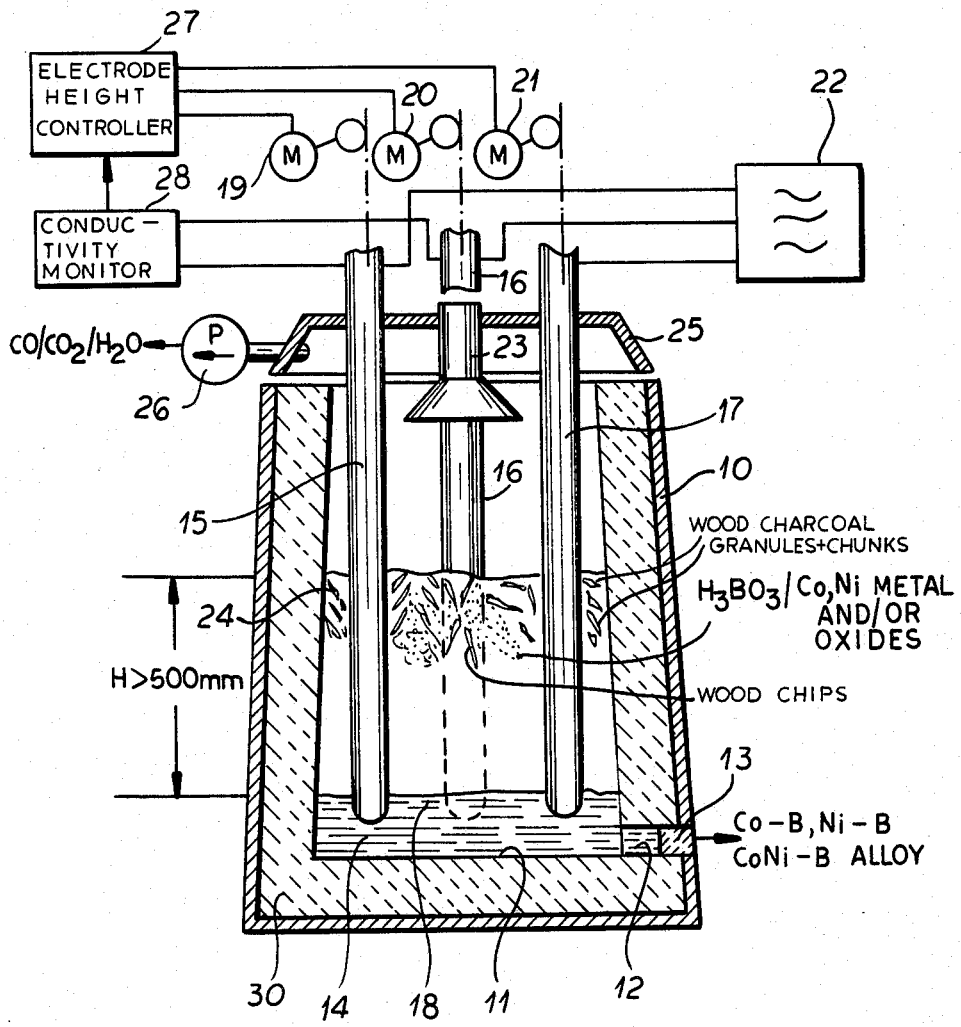
27
ELECTRODE HEIGHT CONTROLLER
20
21
22
M
M
M
19
28
CONDUC-TIVITY MONITOR
16
25
CO/CO2/H2O
P
23
26
17
16
10
15
WOOD CHARCOAL GRANULES+CHUNKS
H3BO3/Co,Ni METAL AND/OR OXIDES
24
H>500mm
WOOD CHIPS
13
Co-B, Ni-B CoNi-B ALLOY
30
14
18
11
12

CARBOTHERMAL METHOD OF PRODUCING COBALT-BORON AND/OR NICKEL-BORON

CROSS REFERENCE TO RELATED APPLICATION

This application is related to the commonly assigned copending application Ser. No. 710,969 filed Mar. 12, 1985 entitled "METHOD OF MAKING FERRO-BORON AND FERRO-SILICON ALLOYS MADE BY THIS METHOD".

FIELD OF THE INVENTION

Our present invention relates to a carbothermal method of producing cobalt-boron and/or nickel-boron and, more particularly, to a method of making compositions containing a basic metal, namely, cobalt and/or nickel, and boron in a low-shaft electrical furnace. Specifically, the invention relates to a method for the carbothermal production of basic metal-boron compositions by the reduction of oxidic boron-containing raw materials in the presence of a base metal compound, e.g. an oxide of the base metal, and a carbon material utilizing an electrical furnace and, specifically, a low-shaft electrical furnace from which the boron-containing composition of the basic metal is tapped at the bottom and a charge or burden containing the various reactants is disposed above the melt of the alloy. The invention also relates to new alloys produced by this method.

BACKGROUND OF THE INVENTION

It is known to carbothermally reduce oxidic boron raw materials in a low-shaft electric arc furnace whose electrodes reach toward the furnace bottom from above and are of adjustable height so that close to the furnace bottom, upon which a melt of the alloy is formed, a reducing zone is constituted into which the electrodes extend. The burden or charge above this reducing zone consists of fine-grained boron-containing raw material, fine-grained oxides of the basic metal and/or small pieces of the basic metal as well as carbon carriers. Above the reducing zone, this charge or burden is constituted as a gas-permeable burden layer.

The term "fine-grained" as used herein with reference to the oxides and carbon, refer to a more or less pulverulent material with a particle size up to about 5 mm.

The term "small pieces" with reference to the basic metal, means pieces with a maximum dimension in any direction ranging from 5 to 100 mm and of any shape.

In general, the electrodes are raised and lowered in accordance with the conductivity of the burden, usually with an automatic control system.

Finally, as to general matters, it should be noted that all percentage values given herein, unless indicated otherwise, represent percentage by weight.

Boron alloys consisting of boron, a basic metal and unavoidable impurities of associated elements have been produced heretofore mainly by aluminothermal techniques. By way of example, one can refer to the earlier method of producing ferroboron, described in Durrer/-Volkert, "Metallurgie der Ferrolegierungen" (Metallurgy of Ferroalloys) 1972, pages 689,690. In these processes, the oxidic boron raw material and iron oxide are reduced with aluminum and melted. The product is an aluminum-containing ferroboron of, for example, 5 to 16% boron up to 4% aluminum, a maximum of 1% silicon, a maximum of 3.10% carbon, balance iron and unavoidable impurities. It is also possible to produce ferroboron of, for example, 18 to 20% boron up to 2% aluminum, a maximum of 2% silicon, a maximum of 0.1% carbon, balance iron and unavoidable impurities. While aluminum and silicon can be considered impurities as well, the amounts of these impurities have been given because they ar substantially greater than other common impurities and generally unlike other impurities have an effect upon the properties of the product.

For example, for the production of metallic glasses using ferroboron, the aluminum content thereof is exceptionally disadvantageous because the aluminum easily oxidizes and the resulting oxides can block the nozzles which are used to produce the metallic glasses. Similar disadvantages characterize other hitherto known boron alloys when these are employed as master alloys for the production of amorphous metal alloys.

In the last decade, developments have progressed in the field of amorphous metal alloy production, i.e. the production of alloys of transition metal with metalloids.

When an amorphous structure was desired, generally it was necessary to cool at high speed a molten steam of the low melting composition.

The amorphous metal alloys can be divided into the iron-based alloys, the cobalt-based alloys, the nickel-based alloys, molybdenum-based alloys and other alloys.

Predominantly for the iron- and/or nickel- and/or cobalt-based amorphous metal alloys, the metalloid has been boron. For practically all technologically important amorphous metal alloys, aluminum is a detrimental element. For this reason it has been sought to produce boron-containing master alloys that are practically aluminum free. However, boron alloys were produced by prior art techniques predominantly involving aluminothermal methods and thus could not avoid having a more or less high content of aluminum.

It is, therefore, desirable to make boron alloys of a basic metal which is free from or practically free from, aluminum.

It is a goal of this invention to provide a method of making a cobalt-based boron alloy and/or nickel-based boron alloy which is practically aluminum free, the term "and/or" used here indicating that a single alloy can be formed of boron where the base metal consists of both cobalt and nickel.

It has been proposed to reduce oxidic boron-containing raw materials to produce boron which forms a boron alloy with a basic metal and unavoidable impurities using carbothermal techniques, especially for the production of ferroboron alloys Durrer/Volkert, (op. cit. page 689).

In this case, the burden or charge consists of a carbon carrier in fine-grained form, for example milled coal and milled coke. Generally, the gas permeability of the burden layer here requires that this layer have a height well below 500 mm. The carbon carrier, if wet, may not adequately dry in such layer. The method results in a ferroboron alloy or a ferroboron silicon alloy which is practically free from the detrimental aluminum and can have an aluminum content as low as 0.07%. However, a drawback of this system is the fact that the boron content of the alloy is also comparatively low. The yield is unsatisfactory. In the production of ferroboron alloys by this approach, the boron content can be only about 10% while in the production of ferroboron silicon alloys, the boron content is reduced to about 3% while the silicon content is also about 3%.

Indeed, these problems are not solved when the burden mixture is initially put up as large-particle pellets and a higher charge or burden height is provided in the furnace with the pelletized burden.

Tests have shown that practically the same results are obtained when there is used a cobalt-based boron alloy is used as a nickel based boron alloy.

OBJECTS OF THE INVENTION

It is, therefore the principal object of the present invention to provide a carbothermal method for producing boron alloys, consisting of boron, a base metal and unavoidable impurities which have a low aluminum content but comparatively high boron content by comparison with earlier methods.

Another object of the invention is to provide an improved carbothermal process whose yield is increased over prior art methods and which has a comparatively low energy consumption with respect to the yield obtained.

SUMMARY OF THE INVENTION

These objects and others which will become apparent hereinafter are attained, in accordance with the invention, in a method for the carbothermal production of a boron alloy consisting of boron, a base metal and unavoidable impurities, which is low in aluminum and has a comparatively high boron content and which is effected in a low-shaft electric arc furnace by reduction of the boron-containing raw material. The furnace is provided with adjustable-height electrodes reaching into a burden which is gas permeable and disposed above the molten alloy on the furnace bottom and whereby the electrodes are adjustable in height and project into a reduction zone of the burden disposed above but close to the furnace bottom. The charge consists of fine-grained oxides of the base metal and/or small pieces of base metal, a carbon carrier and, of course, the oxidic boron raw material. The boron alloy is collected upon and tapped from the furnace bottom.

According to the present invention, the allow produced is a cobalt-based boron alloy and/or nickel-based boron alloy, the burden contains an amount of 20 to 65% by weight of the carbon carrier used in the form of wood with a piece size of 2 to 250 mm, i.e. a maximum dimension of the particles of the wood is 2 to 250 mm, the burden having a layer height of at least 500 mm so chosen that the wood or carbon carrier may be dried and carbonized, i.e. the height of the charge or burden is selected to be at least sufficient to dry and carbonize the wood, i.e. dry it to wood charcoal. The balance of the carbon can also be charcoal.

The resulting cobalt-based boron alloys and/or nickel-based boron alloys have been found to be perfect master alloys for the reduction of amorphous metal alloys.

In general, the cobalt-based boron alloy or nickel-based boron alloy can contain 10 to 20% (preferably 15 to 18%) boron and less than 0.15% aluminum.

The burden layer is preferably provided in a layer thickness of 800 to 1200 mm, so that it is in effect a column. When the burden layer height is about 1000 mm, the furnace can be operated with preferred power of 500 kVA. Best results are obtained with three-phase electrical current low-shaft furnaces.

The invention is based upon our discovery that the basic metal oxide can be reduced to comparatively low temperatures by carbon monoxide and carbon at the upper part of the burden layer which is sufficiently thick that it is a veritable burden column. When at least some of the basic metal is introduced in small-piece form, the low temperature ensures that it will not melt prematurely at the top of this column and obstruct gas penetration through the latter. In the reduction zone, which is at a substantially higher temperature, the oxidic boron raw material effectively reacts in accordance with the boric acid to carbon reaction whereby 3 mols of carbon react with 1 mol of boron oxide to yield 2 mols of boron and 3 mols of carbon monoxide. The latter rises through the burden column as a hot gas to dry and cokefy the wood and effect the metal oxide reduction. The boron oxide reduction is effected at a temperature of about 1600° C. or higher. The finely divided base metal, formed by reduction at a higher portion of the burden or added in small pieces, gradually moves downwardly to the reduction zone and combines with the boron to produce stable borides, a process which is facilitated by the reducing conditions in this zone.

The burden column, therefore, acts as a filter and condensor in part because the wood is transformed into wood charcoal and any boron oxide which tends to volatilize is tapped in this wood charcoal and is entrained with it into the reduction zone. Excessive compaction of the charge is avoided. Boron oxide recovery and recycling is antogenic. The low-shaft electrical furnace can be operated in a dry mode whereby the wood is converted to the wood charcoal.

BRIEF DESCRIPTION OF THE DRAWING

The above and other objects, features and advantages of the present invention will become more readily apparent from the following description, reference being made to the accompanying highly diagrammatic drawing the sole FIGURE of which is a cross section through a low-shaft electrical furnace for practicing the present invention.

SPECIFIC DESCRIPTION

In the drawing, we show a low-shaft electric arc furnace 10 whose hearth or furnace bottom 11 is provided at the level of a tapping hole 12 having a plug 13 which can be penetrated or extracted to tap a melt of cobalt-boron and/or nickel-boron from the furnace.

Three electrodes 15, 16, 17 extend downwardly into the melt 14 to define immediately above the bottom 11 of the furnace a reduction zone 18. The electrodes are vertically shiftable, e.g. by motors 19, 20 and 21 whose pinions can engage racks connected with the electrodes.

The three-phase electrical source 22 energizes these electrodes which are disposed in a triangular array.

A charging device 23 opens into the top of the furnace for continuously feeding the components of the burden or charge 24 into the latter to maintain a substantially constant charge height H in excess of 500 mm as previously described.

A hood 25 is connected to a suction blower 26 for evacuating the gases evolved in the furnace, namely, water vapor, carbon monoxide, and carbon dioxide. The motors 19, 20 and 21 are controlled by an electrode-height controller 27 which receives its input from a conductivity monitor 28 connected across at least two of the electrodes for monitoring the electrical conductivity between them and hence the depth to which the electrodes should be immersed into the melt or introduced into the burden.

The charge is continuously added to the upper portion of the burden 24, which consists of a mixture containing a carbon carrier of which at least 20 to 65% is wood chips, boric acid or other oxidic boron raw material and cobalt and/or nickel oxide and/or pieces. The metallic cobalt and nickel are formed throughout the charge by reduction of the respective oxides with rising carbon monoxide while reduction of the boron oxide takes place at the reduction zones. The rising gases produce charcoal by cokification of the dry wood chips. The charcoal recycles volatile boron.

SPECIFIC EXAMPLES

EXAMPLE 1

In a three-phase low shaft electric inner furnace operating at 300 kW power, having a lining 30 of packed carbon and having a hearth area 11 of 0.785 $m^2$, the burden is built to a height in excess of 500 mm within the shaft which has a height of 900 mm (and up to 900 mm) and is continuously replenished in the proportions given for the initial charge:

100 kg technical grade boric acid $H_3BO_3$ (57.1% $B_2O_3$)
109.5 kg cobalt oxide (71% Co)
37 kg wood charcoal grains with a particle size of 1 to 3 mm (73.4% $C_{fix}$)
62 kg sawdust with a particle size ranging from 5 to 250 mm.

The cobalt alloy which is tapped from the furnace continuously contains 15.6 to 17.2% boron, 0.2% carbon, 0.10% aluminum, balance cobalt. The boron yield or conversion is 93% and the current demand is 35 to 36 kWh/kg B (product).

EXAMPLE 2

Practically identical results were obtained with the same furnace for the following charge under similar conditions:

100 kg boric acid $H_3BO_3$
77.7 kg cobalt metal as chips machined from a cobalt cathode with a particle size of 5 to 30 mm
30 kg wood charcoal grains with a particle size of 1 to 3 mm
46 kg of sawdust The tapped alloy contains 16.3 to 18.5% boron, 0.2% carbon and less than 0.10% aluminum. The power composition was 30 kWh/kg boron (product) and the boron yield or conversion was 94%.

EXAMPLE 3

In a similar three-phase electric arc furnace having a power of 300 kW the charge was continuously fed after establishing an initial charge of:

100 kg boric acid ($H_3BO_3$ - technical grade as above)
78 kg nickel metal in the form of machine chips of a particle size of 5 to 35 mm from a nickel cathode
32 kg of wood charcoal grains as above
44.5 kg of sawdust The alloy produced by continuous operation had a boron content of 17.7%, a carbon content of 0.15%, and an aluminum content of less than 0.10%.

The power consumption was 36 kWh/kg boron (in product) and the yield or conversion with respect to boron was 91.5%.

We claim:

1. A method of producing a boron alloy selected from the group consisting of a cobalt-based, a nickel-based, and a cobalt- and nickel-based boron alloy with less than 0.15% aluminum which comprises the steps of:

(a) maintaining a porous charge consisting essentially of an oxidic boron compound, at least one base-metal component selected from the group consisting of oxidic cobalt containing raw materials, oxidic nickel-containing raw material, pieces of cobalt metal, pieces of nickel metal and mixtures thereof, and a carbon carrier of which at least 20 to 65% by weight is constituted of wood in a particle size range of 2 to 250 mm, above a reduction zone of a low-shaft electrical furnace, said alloy in a molten state collecting on and being removed from a floor of said furnace;

(b) electrically heating said reduction zone by passing an electric current between a plurality of electrodes extending into said reduction zone just above the floor of said furnace to effect a reduction reaction therein, thereby forming said alloy and producing carbon monoxide to reduce any basic oxidic basic metal raw material at an upper part of said charge; and maintaining the height of said charge in said furnace during the formation of said alloy sufficient to effect dry carbonization of said wood in said charge to wood charcoal.

2. The method defined in claim 1 wherein said charge is constituted such that the alloy collected on said floor or said furnace contains 10 to 20% by weight boron and less than 0.15% by weight aluminum.

3. The method defined in claim 2 wherein said alloy collected on said floor contains 15 to 18% by weight boron.

4. The method defined in claim 1 wherein said charge has a height of substantially 800 to 1200 mm.

5. The method defined in claim 4 wherein said furnace has a power of substantially 500 to 1500 kVA.

6. The method defined in claim 5 wherein said charge has a height of substantially 1000 mm.

7. The method defined in claim 1 wherein said furnace is operated with three-phase electric current.

8. The method defined in claim 1 wherein a cobalt-boron alloy is produced.

9. The method defined in claim 1 wherein a nickel-boron alloy is produced.

10. The method defined in claim 1 wherein said charge initially comprises wood charcoal constituting said carbon carrier together with the wood particles.

* * * * *